US010048051B1

(12) United States Patent
Smitchko

(10) Patent No.: US 10,048,051 B1
(45) Date of Patent: Aug. 14, 2018

(54) FIREARM PROJECTILE

(71) Applicant: Daniel J. Smitchko, Morrisdale, PA (US)

(72) Inventor: Daniel J. Smitchko, Morrisdale, PA (US)

(73) Assignee: Cutting Edge Bullets, LLC, Drifting, PA (US)

( * ) Notice: Subject to any disclaimer, the term of this patent is extended or adjusted under 35 U.S.C. 154(b) by 0 days.

(21) Appl. No.: 15/183,823

(22) Filed: Jun. 16, 2016

Related U.S. Application Data

(60) Provisional application No. 62/181,283, filed on Jun. 18, 2015.

(51) Int. Cl.

| | |
|---|---|
| ***F42B 8/00*** | (2006.01) |
| ***F42B 12/00*** | (2006.01) |
| ***F42B 30/00*** | (2006.01) |
| ***F42B 12/06*** | (2006.01) |
| ***F42B 14/00*** | (2006.01) |
| ***F42B 14/02*** | (2006.01) |
| ***F42B 12/74*** | (2006.01) |

(52) U.S. Cl.
CPC ..... *F42B 12/06* (2013.01); *F42B 12/74* (2013.01); *F42B 14/00* (2013.01); *F42B 14/02* (2013.01)

(58) Field of Classification Search
CPC ..... F42B 12/06; F42B 12/74; F42B 14/00; F42B 14/02
USPC ..... 102/518, 519
See application file for complete search history.

(56) References Cited

U.S. PATENT DOCUMENTS 1,402,776 A * 1/1922 Lefevre ..... F42C 1/04 102/519
1,892,152 A * 12/1932 Jones ..... F42B 12/06 102/518
2,055,765 A * 9/1936 Hayden ..... F42B 10/42 244/3.25
2,288,604 A * 7/1942 Born ..... F41A 21/16 102/514
2,322,751 A * 6/1943 Studler ..... F42B 12/06 102/516
2,356,227 A * 8/1944 Diehl ..... F42B 10/22 102/519
2,435,095 A * 1/1948 Nichols ..... F42B 12/06 102/275
2,485,887 A * 10/1949 Jordan ..... F42B 12/06 102/216
2,958,287 A * 11/1960 Auxier ..... F42B 12/78 102/507
3,067,685 A * 12/1962 Ludwig ..... F42B 5/02 102/373
3,170,405 A * 2/1965 Jungermann ..... F42B 8/14 102/529
3,720,170 A * 3/1973 Godfrey ..... F42B 12/78 102/516
3,795,196 A * 3/1974 Hillenbrand ..... F42B 12/06 102/518
4,108,072 A * 8/1978 Trinks ..... F42B 12/06 102/518

(Continued)

*Primary Examiner* — Samir Abdosh
(74) *Attorney, Agent, or Firm* — John J. Elnitski, Jr.

(57) ABSTRACT

A projectile having a projectile body that includes a front end and a rear end. A cavity in the rear end of the projectile body. An internal core in the cavity. The internal core including a front end and a rear end. The front end of the internal core inserted towards the front end of the projectile body.

18 Claims, 7 Drawing Sheets

(56) References Cited

U.S. PATENT DOCUMENTS

| | | | | | |
|---|---|---|---|---|---|
| 4,612,860 | A * | 9/1986 | Flatau | F42B 12/06 | 102/364 |
| 4,878,434 | A * | 11/1989 | Sommet | F42B 12/78 | 102/514 |
| 5,105,713 | A * | 4/1992 | Wirgau | F42B 6/006 | 102/517 |
| 6,085,661 | A * | 7/2000 | Halverson | F42B 12/74 | 102/516 |
| 6,374,743 | B1 * | 4/2002 | Hug | F42B 12/74 | 102/514 |
| 7,150,233 | B1 * | 12/2006 | Eberhart | F42B 12/74 | 102/516 |
| 2005/0126422 | A1 * | 6/2005 | Lamm | F42B 8/12 | 102/518 |
| 2007/0163459 | A1 * | 7/2007 | MacDougall | F42B 12/06 | 102/514 |
| 2012/0266772 | A1 * | 10/2012 | Eckstein | F42B 12/60 | 102/439 |
| 2016/0252332 | A1 * | 9/2016 | Gelfert | F42B 5/067 | 102/464 |

* cited by examiner

SEAL TIGHT BAND DETAIL C
SCALE 30 : 1

FIREARM PROJECTILE

This application claims the benefit of and incorporates by reference U.S. Provisional Applications No. 62/181,283, filed Jun. 18, 2015.

BACKGROUND

The present invention generally relates firearm projectiles. More specifically, the present invention relates to projectiles to penetrate harden targets.

Projectiles, often referred to as bullets, are designed with a single purpose in mind. Typically, that single purpose is deep penetration or controlled expansion for terminal performance as the single purpose. Another purpose is penetration of harden targets. Most harden targets are protected by armor made of metal or other materials meant to repel projectiles.

It is an object of the present invention to provide projectile to penetrate harden targets.

SUMMARY OF THE INVENTION

A projectile having a projectile body that includes a front end and a rear end. A cavity in the rear end of the projectile body. An internal core in the cavity. The internal core including a front end and a rear end. The front end of the internal core inserted towards the front end of the projectile body.

DETAILED DESCRIPTION

Figure 3:
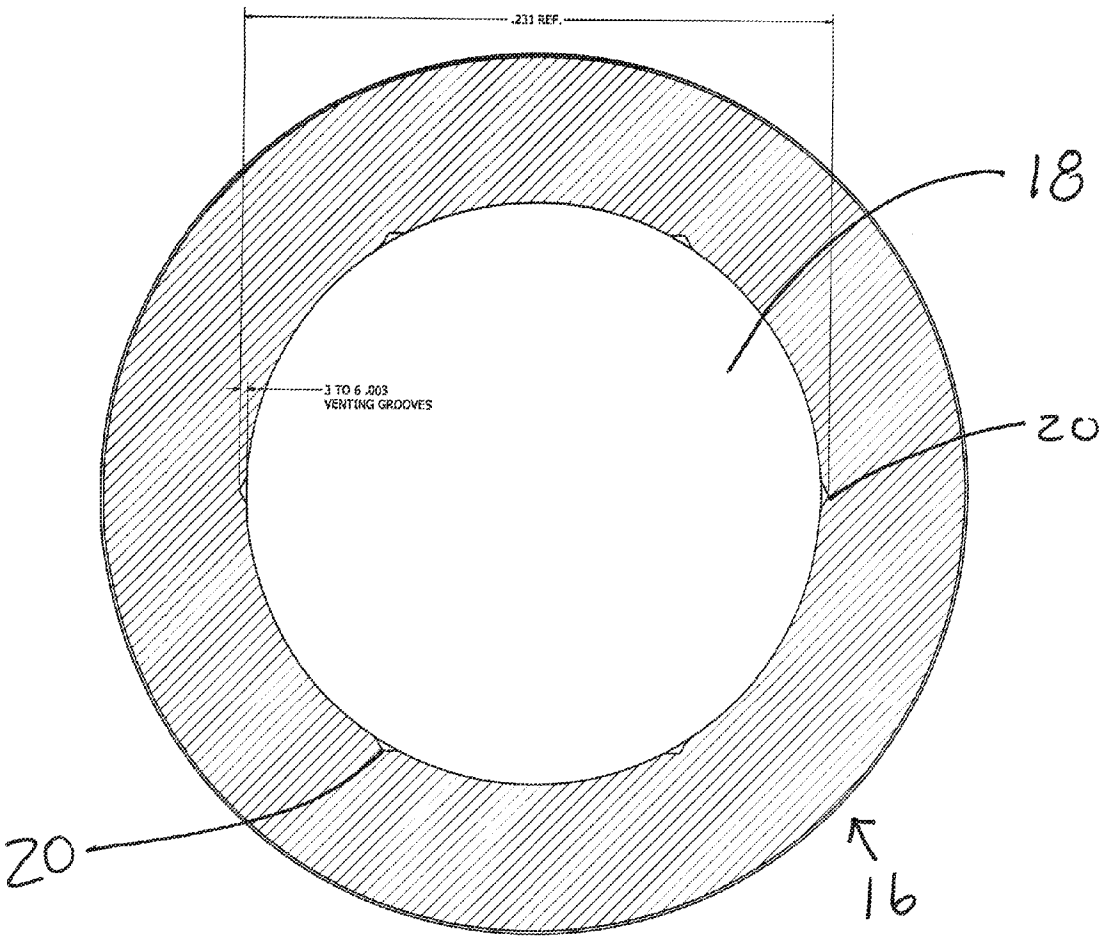
FIG. 3 is an end view of a projectile according to the present invention.
Figure 4:
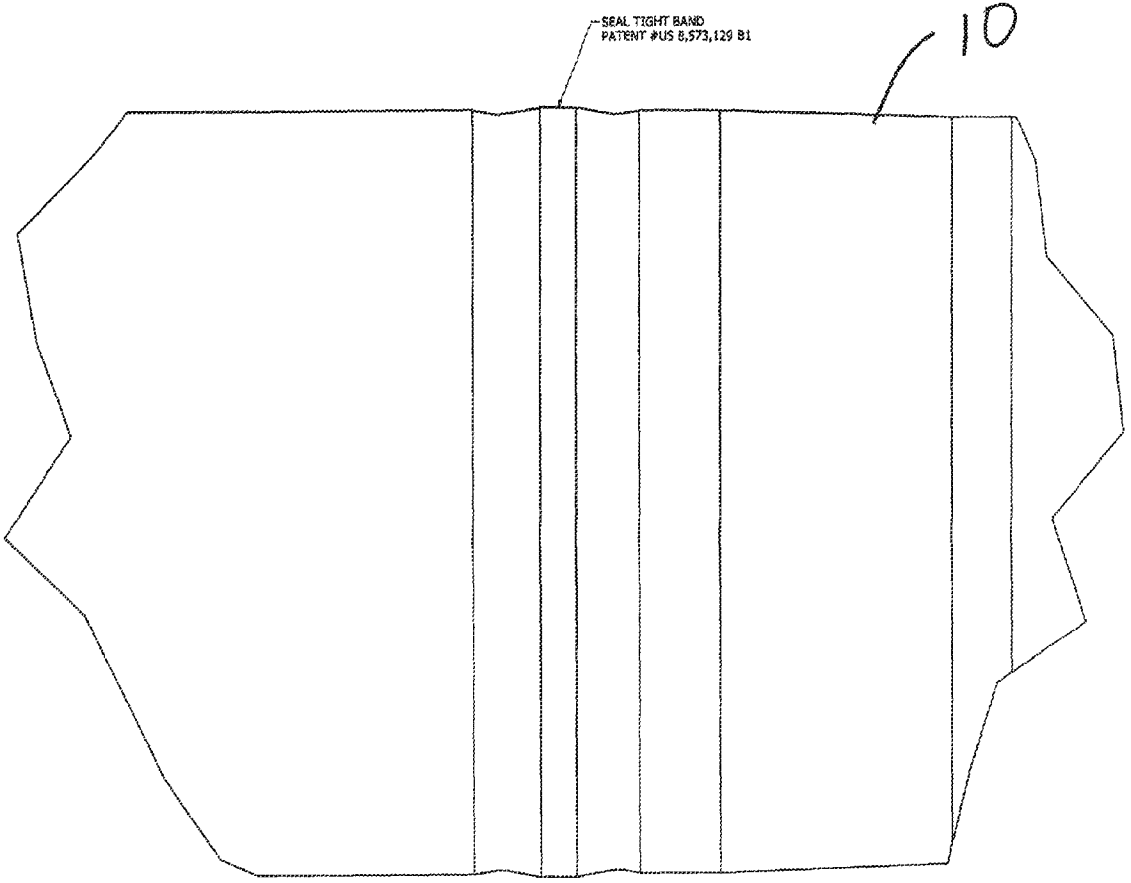
FIG. 4 is a side view of a seal band on a projectile according to the present invention.
Figure 5:
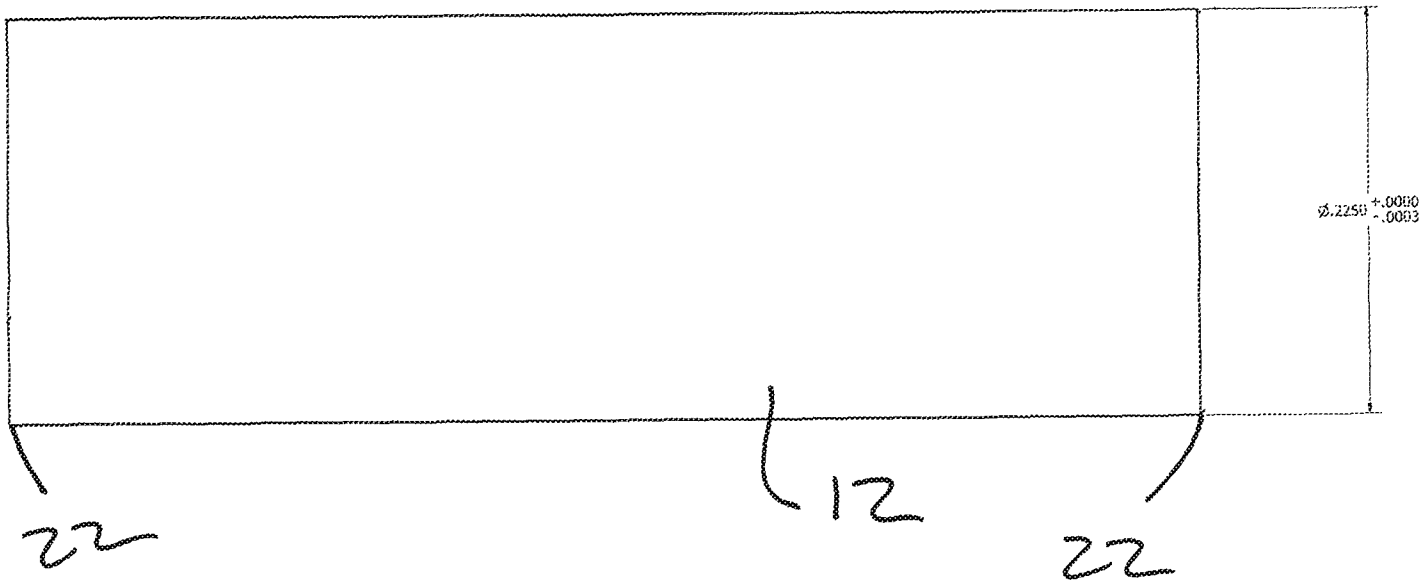
FIG. 5 is a side view of an internal core according to the present invention.
Figure 6:
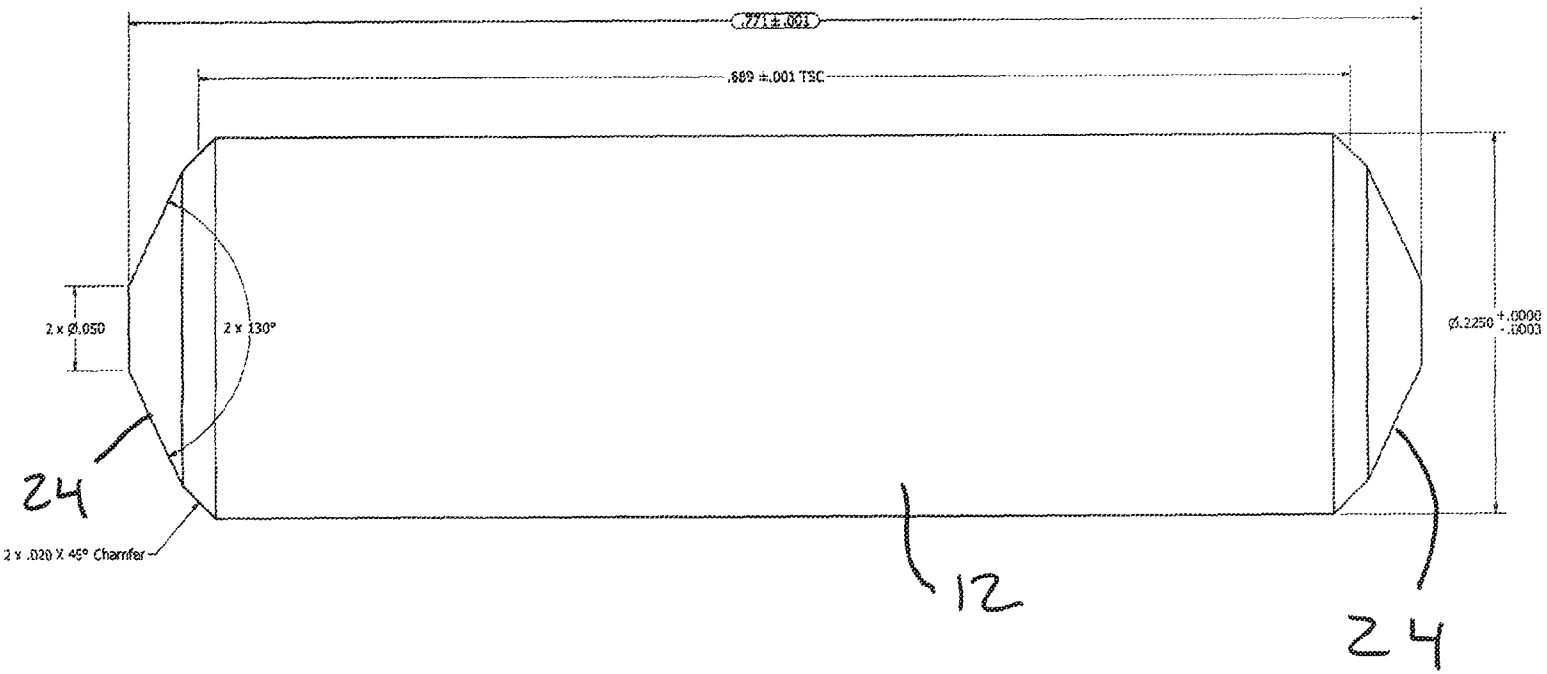
FIG. 6 is a side view of an internal core according to the present invention.
Figure 7:
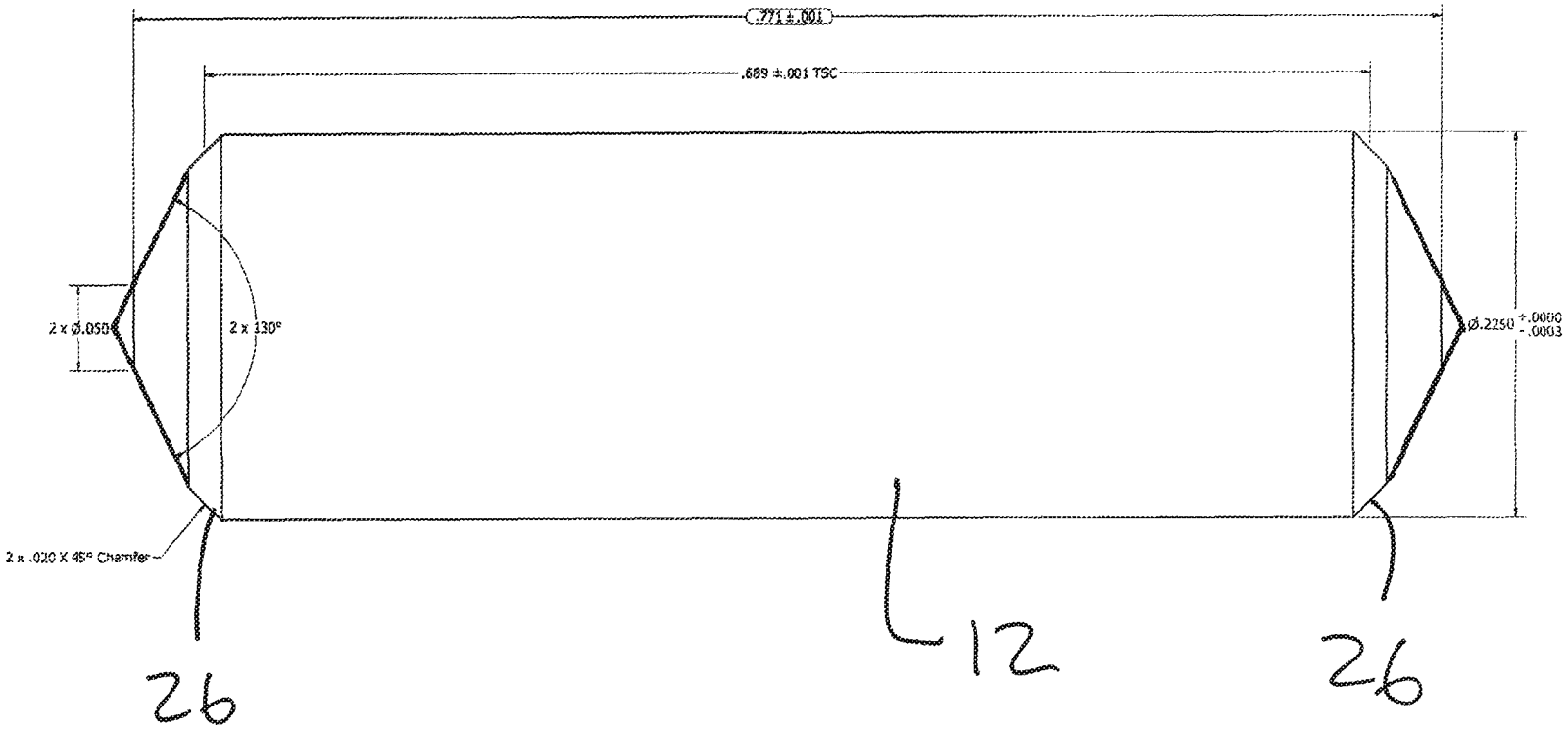
FIG. 7 is a side view of an internal core according to the present invention.

FIGS. 1-7 show components of a two piece projectile configured to defeat various levels of body armor, as well as complete penetration of different types of materials at long range, including armor plate. With the two piece projectile, the purpose is to penetrate "hardened" targets not capable of being penetrated with customary cup and core bullets or monolithic brass or copper/copper alloy bullets. The first piece is a projectile body 10 of which different views are shown in FIGS. 1-4. The projectile body 10 is of monolithic construction from one material capable of conforming to an internal surface of a rifle barrel. The second piece is an internal core 12, of which different views are shown in FIGS. 5-7. The internal core 12 is constructed of a material that is hard and dense enough to penetrate armor plate and various materials at various ranges including long range.

Figure 1:
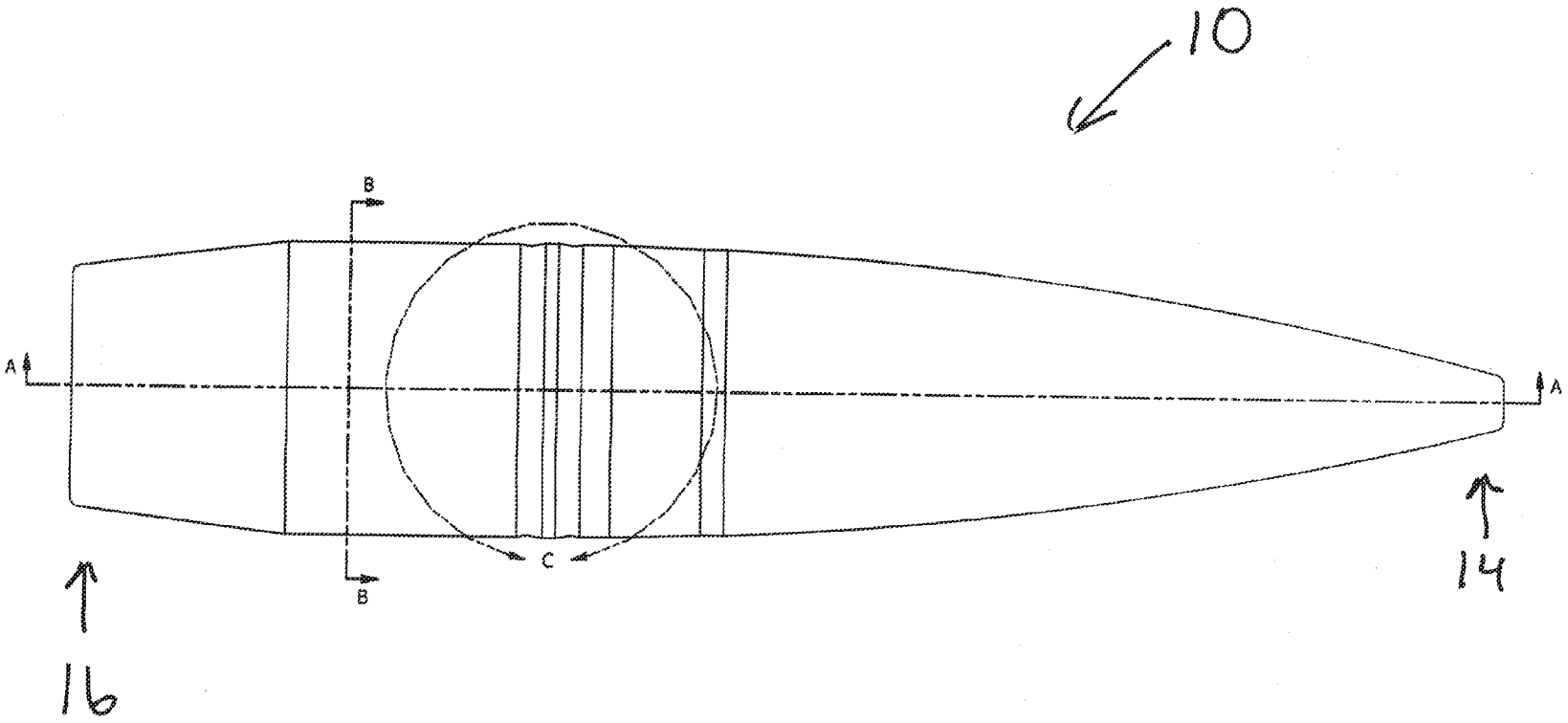
FIG. 1 is a side view of a projectile according to the present invention.
Figure 2:
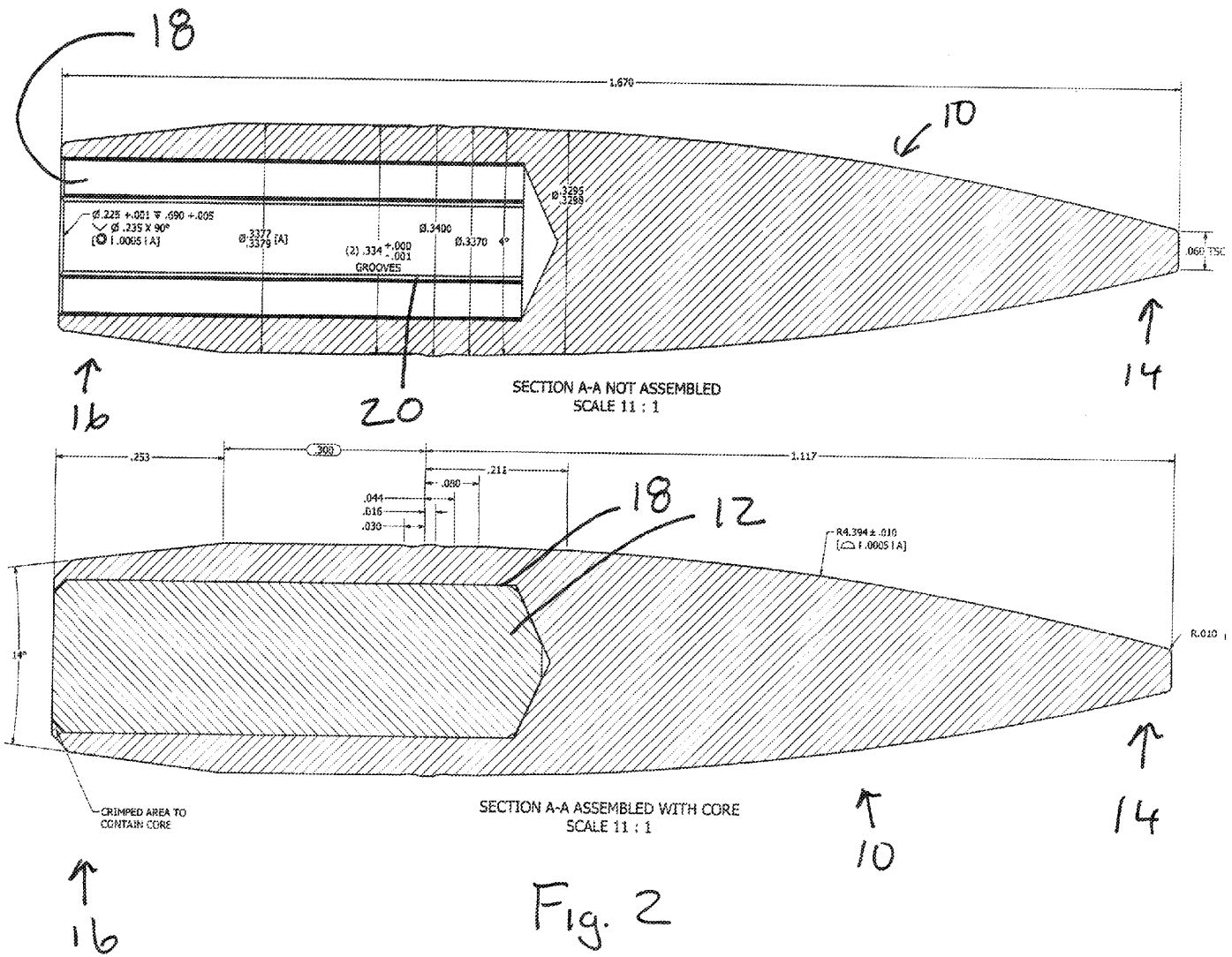
FIG. 2 are cross-sectional views of a projectile according to the present invention.

The projectile body 10 shown in FIGS. 1-2 is machined to very close tolerances. The projectile body 10 is shown with a solid point design on the front end 14 as shown and a boat tail rear portion on the rear end 16. The projectile body 10 is not limited to a solid point design on the front end 14 and a boat tail rear portion on the rear end 16. One material the projectile body 10 can be made of copper, is there are other materials that can be used for the projectile body 10. The rear end 16 of the projectile body 10 has a precision cavity 18 machined in it to accept the internal core 12, as shown in FIGS. 2-3. The precision cavity 18 has linear grooves 20 machined into the precision cavity 18 to a depth for de-airing during installation of the internal core 12. De-airing is the release of air from the precision cavity 18 trapped, as the internal core 12 is installed so that any trapped air has an escape path along the linear grooves 20. The rear end 16 of the projectile body 10 can also be flat without an angled portion, or boat tail, in some circumstances depending on the intended use of the projectile. The projectile body 10 may also be self-sealing as covered under U.S. Pat. No. 8,573,129 B1 or include other types of grooves cut into the body to reduce fouling and barrel pressure, as shown in FIGS. 1 and 4.

The internal core 12 is of a material that is harder and denser than the material to be penetrated by the internal core 12. Depending on the penetration requirement, the shape of the ends of the internal core 12 can vary, as shown in FIGS. 5-7. FIG. 5 shows the internal core 12 having flat ends 22. FIG. 6 shows the internal core 12 having a small symmetrical crimping chamfer with a flat finish on each end 24. FIG. 7 shows the internal core having pointed ends 26. The point of the pointed ends 26 can sharp as shown or also bunt or flat ended. The shape of the ends of FIGS. 5-7 can be mixed and match to serve different purposes. In all cases the core will be made of a material capable of penetrating hardened armor at long ranges. During assembly, a small amount of adhesive may or may not be used to adhere the internal core 12 inside the precision cavity 18 upon installation. If adhesive is used, the linear grooves 20 will provide a path for excess adhesive to travel along during installation of the internal core 12. The linear grooves 20 can provide additional gripping surface for the adhesives. The internal core 12 can also be secured by crimping the end 16 of the projectile body 10 about the internal core 12, as shown in FIG. 2.

When the projectile strikes armor plate, the projectile body 10, starting at the tip of the front end 14, hits the plate and begins to disintegrate creating heat. The projectile body 10 material completely disintegrates which softens the plate surface slightly and makes it easier for the hardened internal core 12 to penetrate the plate. Then, the internal core 12 makes contact and plows its way through the plate due to the internal core 12 being harder and denser than the plate. The nose design of the internal core 12 has to be sufficient to defeat the armor plate and not fracture the internal core 12. A fragile point on the internal core 12 could cause fracture of the internal core 12 on impact. A fracture of the internal core 12 could cause a loss of mass and cause the internal core 12 to veer off course causing even more fracturing and loss of penetration. It is important the internal core 12 has the correct balance of hardness, toughness and density, so it is not too brittle. An example of parameter ranges for the internal core 12 are a density between 12-16; a hardness between 80 ra-90 ra and grain structures between 2-6 microns. A corrosion resistant tungsten carbide would be a good material for the internal core 12.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A projectile to penetrate a material comprising:

a projectile body, said projectile body having a front end and a rear end, said projectile body being of a monolithic construction from one material;

a cavity in said rear end of said projectile body; and an internal core in said cavity, said internal core including a front end and a rear end, and said front end of said internal core inserted towards said front end of said projectile body, said internal core being of an unfragmented monolithic construction from one material and said cavity having a plurality of linear grooves positioned about its inner surface such that the cavity is de-aired through said grooves during installation of said core.

2. The projectile of claim 1, wherein said internal core is constructed of a material that is harder and denser than the material designated to be penetrated by said projectile.

3. The projectile of claim 1, wherein said front end of said internal core is flat.

4. The projectile of claim 1, wherein said rear end of said internal core is flat.

5. The projectile of claim 1, wherein said front end of said internal core is pointed and said rear end of said internal core is pointed.

6. The projectile of claim 5, wherein said front end and said rear end of said internal core includes a blunt end.

7. The projectile of claim 1, wherein said front end of said internal core is pointed and includes is tapered and ends in a blunt end.

8. The projectile of claim 1, wherein said rear end of said internal core is includes a symmetrical crimping chamfer.

9. The projectile of claim 1, wherein said front end of said internal core is includes a symmetrical crimping chamfer.

10. The projectile of claim 8, wherein said rear end of projectile body is crimped about said symmetrical crimping chamfer at said rear end of said internal core.

11. The projectile of claim 1, wherein said rear end of projectile body is crimped about said rear end of said internal core.

12. The projectile of claim 11, wherein said internal core is constructed of a material that is harder and denser than the material designated to be penetrated by said projectile the internal core.

13. The projectile of claim 11, wherein said cavity includes linear grooves machined along said cavity for de-airing during installation of said internal core due to fit between said internal core and said surface of said cavity.

14. The projectile of claim 1, wherein an outside surface of said projectile body is deformable against an inside surface of a barrel and self-sealing when fired through a barrel.

15. The projectile of claim 1, wherein said projectile body includes grooves to reduce fouling and barrel pressure.

16. The projectile of claim 1, further including adhesive between said internal core and said cavity.

17. The projectile of claim 11, further including adhesive between said internal core and said cavity.

18. The projectile of claim 11, wherein the internal core is a metal alloy tempered to include includes ranges of a density between 12-16; a hardness between 80 ra-90 ra and grain structures between 2-6 microns.

* * * * *